US008869353B2

(12) United States Patent
Hsu et al.

(10) Patent No.: US 8,869,353 B2
(45) **Date of Patent: *Oct. 28, 2014**

(54) SYNCHRONOUS FOLDING DEVICE

(71) Applicant: First Dome Corporation, New Taipei (TW)

(72) Inventors: An Szu Hsu, New Taipei (TW); Way Han Dai, New Taipei (TW)

(73) Assignee: First Dome Corporation, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/771,298

(22) Filed: Feb. 20, 2013

(65) Prior Publication Data

US 2014/0174227 A1 Jun. 26, 2014

(30) Foreign Application Priority Data

Dec. 21, 2012 (TW) ..... 101224881 A

(51) Int. Cl.
*E05D 15/00* (2006.01)
*E05D 7/00* (2006.01)
*E05D 3/14* (2006.01)

(52) U.S. Cl.
CPC ..... *E05D 3/14* (2013.01)
USPC ..... 16/368; 16/364; 16/366

(58) Field of Classification Search
USPC ..... 16/366, 368, 369, 370, 354, 365; 403/80, 81
See application file for complete search history.

(56) References Cited

U.S. PATENT DOCUMENTS

| | | | | | |
|---|---|---|---|---|---|
| 3,483,588 | A * | 12/1969 | Hover | 16/354 |
| 4,599,998 | A * | 7/1986 | Castillo | 602/16 |
| 5,570,971 | A * | 11/1996 | Rixen et al. | 403/381 |
| 8,562,236 | B2 * | 10/2013 | Eikelenboom | 403/81 |
| 2008/0109995 | A1 * | 5/2008 | Kuwajima et al. | 16/354 |
| 2008/0284295 | A1 * | 11/2008 | Lai et al. | 312/223.2 |
| 2009/0000062 | A1 * | 1/2009 | Yamanami | 16/366 |
| 2010/0024169 | A1 * | 2/2010 | Self | 16/354 |
| 2011/0000136 | A1 * | 1/2011 | Brun | 49/358 |
| 2011/0097138 | A1 * | 4/2011 | Eikelenboom | 403/81 |
| 2011/0271486 | A1 * | 11/2011 | Wang et al. | 16/319 |

* cited by examiner

*Primary Examiner* — Jeffrey O Brien
(74) *Attorney, Agent, or Firm* — Rosenberg, Klein & Lee

(57) ABSTRACT

A synchronous folding device includes two opposing folding members and a multi-joint rotary axle structure mounted between the two folding members. The multi-joint rotary axle structure has two ends which can be folded or unfolded synchronously. The multi-joint rotary axle structure includes a driving joint assembly and a driven joint assembly. The driving joint assembly includes two opposing joint plates and a middle link plate. Two ends of the driving joint assembly are respectively connected to the two opposing folding members. Each joint plate of the driving joint assembly can be turned free through plural turning centers so that both ends can be closed or opened synchronously for the folding device to be folded or unfolded accurately.

38 Claims, 15 Drawing Sheets

SYNCHRONOUS FOLDING DEVICE

BACKGROUND OF THE INVENTION

1. Field of the Invention

The present invention relates to a synchronous folding device, and more particularly to a synchronous folding device for an electronic apparatus. The synchronous folding device comprises two opposing folding members and a multi-joint rotary axle structure mounted between the two folding members. The multi-joint rotary axle structure has two ends which can be folded or unfolded synchronously so that both ends of the electronic apparatus can be closed or opened smoothly.

2. Description of the Prior Art

Nowadays, an electronic apparatus having opposing folding members (such as foldable monitor, handheld game console, PDA, cell phone, electronic book, outer casing of an electronic product, or the like) comprises a base, a foldable upper cover, and a pivotal device connected between the base and the upper cover. The upper cover is turned about the pivotal device to fold or unfold the two folding members. The pivotal device is as the axle center of the electronic apparatus so the design of the structure must consider whether the operation relative to the base is smooth or not. When the upper cover is opened to a desired angle (for example, the screen of the notebook is opened to 135 degrees), the pivotal device must have enough support force to position the screen at the operation angle.

In general, the pivotal device comprises a connection member having a spindle and another connection member having a spindle sleeve. The spindle and the spindle sleeve are connected with each other. One connection member is mounted to the upper cover, and the other connection member is mounted to the base. To consider the support strength, the two connection members having the spindle and the spindle sleeve are disposed at two opposing edges of the upper cover and the base of the electronic apparatus. For a long time, subject to the configuration of the spindle and the spindle sleeve, the support strength of the operation angle and the smooth and light operation to fold and unfolded are limited.

Due to the functional limit of the aforesaid pivotal device and the demand for a larger angle of turning, a pivotal device not having the same spindle is developed and mounted between the upper cover and the base of the electronic apparatus. The coordination of the two spindles of the pivotal device cannot be controlled so the electronic apparatus cannot be closed or opened accurately and smoothly and the demand for a light operation cannot be achieved.

Accordingly, the inventor of the present invention has devoted himself based on his many years of practical experiences to solve these problems.

SUMMARY OF THE INVENTION

The primary object of the present invention is to provide a synchronous folding device which can enhance the accuracy of the degree of freedom of the rotary axle mounted to an electronic apparatus.

Another object of the present invention is to provide a synchronous folding device which provides a multi-joint rotary axle structure for both ends of an electronic apparatus to be opened or closed more smoothly.

In order to achieve the aforesaid objects, the present invention comprises two opposing folding members and a multi-joint rotary axle structure mounted between the two folding members. The multi-joint rotary axle structure has two ends which can be folded or unfolded synchronously. In an embodiment, the multi-joint rotary axle structure comprises at least one driving joint assembly and at least one driven joint assembly. The driving joint assembly comprises two opposing joint plates and a middle link plate assembly. The two opposing joint plates have synchronous actuating portion at respective inner ends thereof to connect the outer ends of the two opposing folding members. The middle link plate assembly has connecting actuating portions at two ends thereof to mate with the synchronous actuating portions at the inner ends of the opposing joint plates. The driven joint assembly is pivotally connected between the two opposing joint plates. The driven joint assembly comprises at least two driven plates which are driven synchronously by the synchronous actuating portions. The inner ends of the two opposing joint plates are linked with the outer ends of the driven plates and connected by axle pins. The outer end of each middle link plate of the middle link plate assembly is linked with the inner end of each driven plate and connected by an axle pin. The driving joint assembly and the driven joint assembly are arranged side by side for the opposing joint plates, the middle link plates and the driven plates to be connected by the axle pins to constitute the multi-joint rotary axle structure. Each joint plate of the driving joint assembly can be turned free through plural turning centers for smooth and light operation.

In an embodiment, the two opposing joint plates have outer axle holes and inner axle holes close to respective two ends thereof. The synchronous actuating portions are disposed at the opposing inner ends of the two opposing joint plates. The middle link plate assembly has axle holes close to two ends thereof and outer connecting actuating portions at the two ends thereof to mate with the inner synchronous actuating portions of the two opposing joint plates. The two driven plates have outer axle holes and inner axle holes. The inner axle holes of the two opposing joint plates are respectively linked with the outer axle holes of the two driven plates and connected by first and second axle pins. Each middle link plate of the middle link plate assembly has outer axle holes which are linked with the inner axle holes of the driven plates and connected by third and fourth axle pins.

In an embodiment, the inner axle holes of the two opposing joint plates, the axle holes of the middle link plate assembly and the inner axle holes of the driven plates have flanges at respective inner peripheries thereof for the axle pins to be connected tightly to provide a positioning and clamping force.

In an embodiment, the two ends of the driving joint assembly are connected by axle pins. The axle pins have respective extension portions. The folding members have corresponding recesses to accommodate the extension portions.

In an embodiment, the two ends of the driving joint assembly are formed with insertion heads to be inserted to the two opposing folding members or locking parts of the folding members. This is beneficial for assembly.

DETAILED DESCRIPTION OF THE PREFERRED EMBODIMENTS

Embodiments of the present invention will now be described, by way of example only, with reference to the accompanying drawings.

Figure 1:
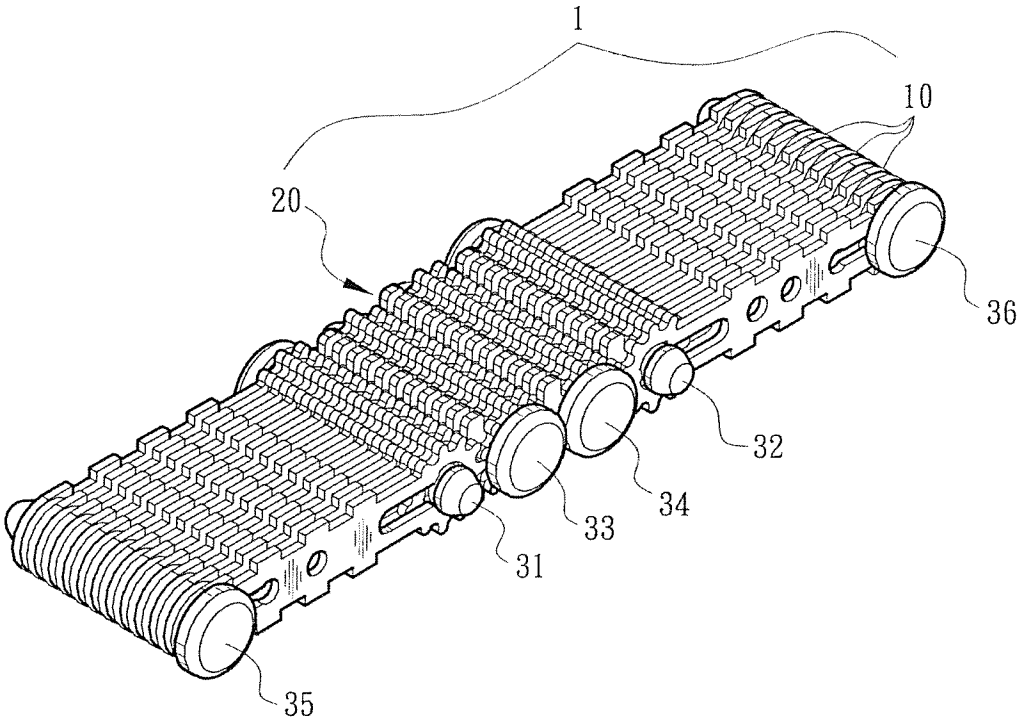
FIG. 1 is a perspective view of the multi-joint rotary axle structure according to a preferred embodiment of the present invention.
Figure 2:
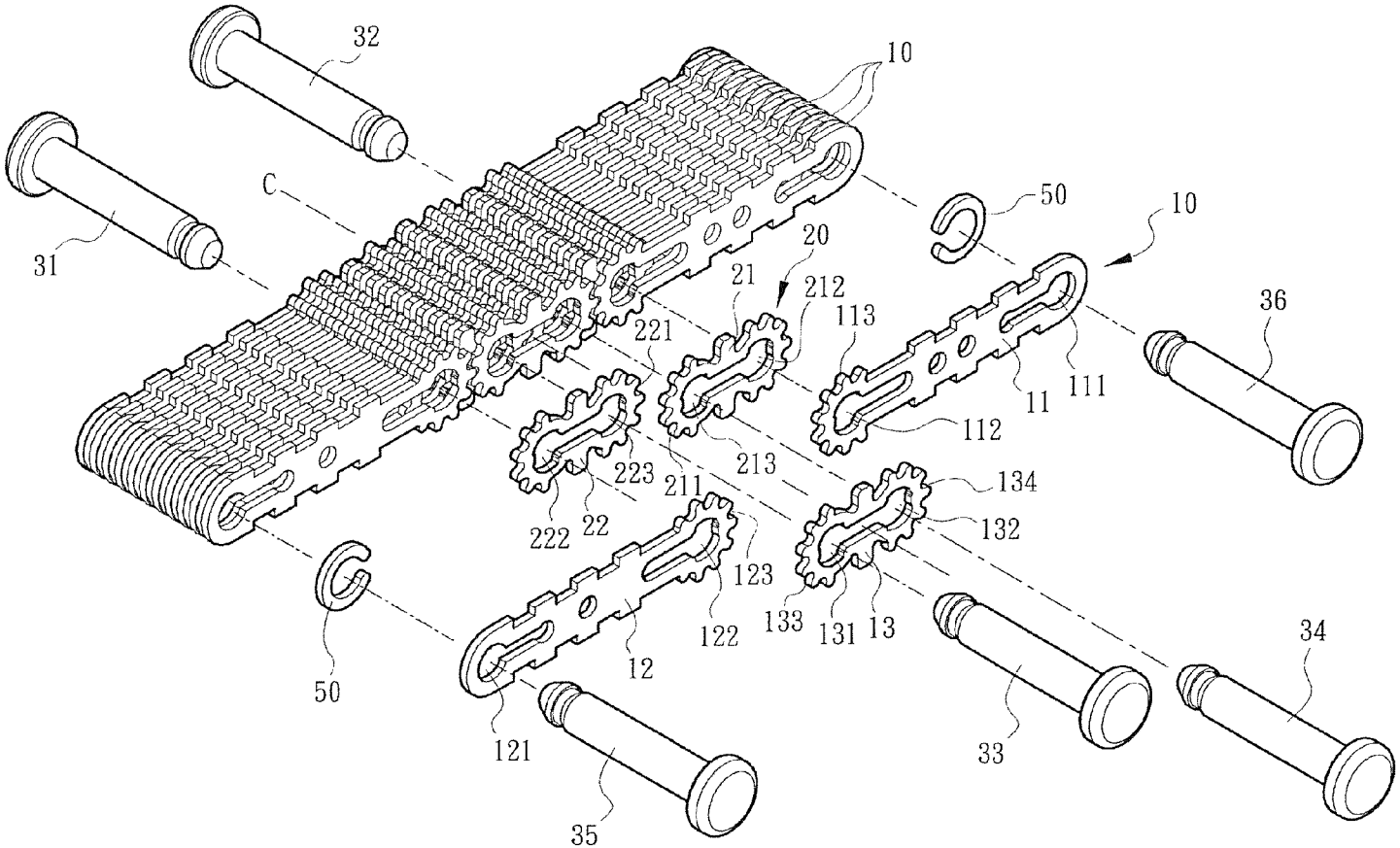
FIG. 2 is an exploded view of FIG. 1.
Figure 3:
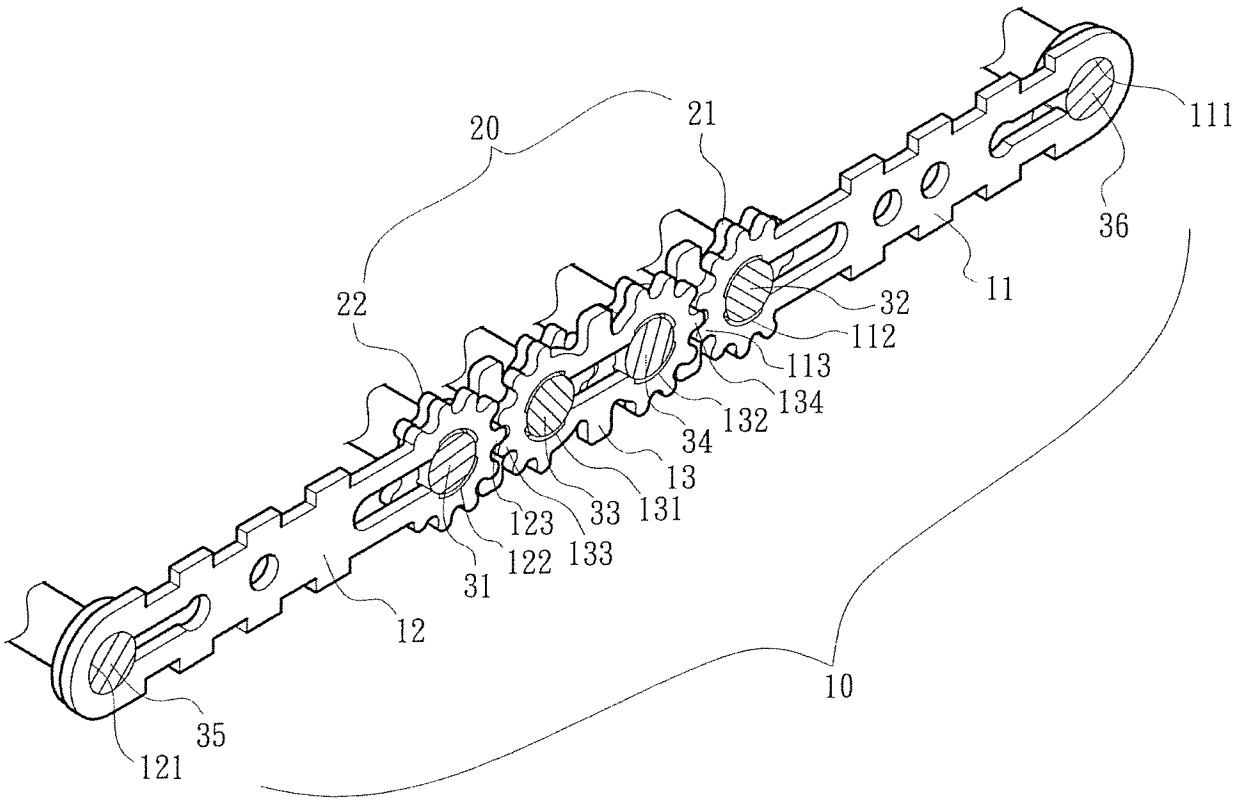
FIG. 3 is an enlarged view of one joint plate assembly of FIG. 1.

Referring to FIG. 8, FIG. 9 and FIGS. 12-14, the present invention comprises two opposing first and second folding members 81, 82 and a multi-joint rotary axle structure 1 mounted between the first and second folding members 81, 82. The multi-joint rotary axle structure 1 has two ends which can be folded or unfolded synchronously. As shown in FIG. 1 to FIG. 3, the multi-joint rotary axle structure 1 comprises at least one driving joint assembly 10 and at least one driven joint assembly 20, as shown in FIG. 3, to cooperate with a plurality of axle pins to constitute the multi-joint rotary axle structure 1.

In order to explain the connection relationship between the parts, the central line C as shown in FIG. 2 is as the reference line to define an "inner" direction which is close to the central line C and an "outer" direction which is far from the central line C.

The driving joint assembly 10 comprises two opposing first and second joint plates 11, 12 and a middle link plate assembly 13 between the first and second joint plates 11, 12. The two opposing first and second joint plates 11, 12 have outer axle holes 111, 121 and inner axle holes 112, 122 close to respective two ends thereof. The two opposing first and second joint plates 11, 12 have synchronous actuating portion 113, 123 at respective inner ends thereof. The middle link plate assembly 13 is located between the first joint plate 11 and the second joint plate 12. The middle link plate assembly 13 comprises at least one middle link plate. The middle link plate assembly 13 has axle holes 131, 132 close to two ends thereof. The middle link plate assembly 13 has two "outer" connecting actuating portions 133, 134 at the two ends thereof to mate with the "inner" synchronous actuating portions 113, 123 of the first joint plate 11 and the second joint plate 12, so that at least one of the first joint plate 11 and the second joint plate 12 is synchronously connected to the middle link assembly 13.

The driven joint assembly 20 is disposed between the first and second joint plates 11, 12 of the driving joint assembly 10. The driven joint assembly 20 comprises at least two first and second driven plates 21, 22 which have synchronous actuating portions 211, 221 at respective inner ends thereof to mate with each other. The first and second driven plates 21, 22 have outer axle holes 212, 222 and inner axle holes 213, 223 at respective ends thereof.

After the driven joint assembly 20 and a plurality of driving joint assemblies 10 are arranged side by side, the inner axle holes 112, 122 of the first joint plate 11 and the second joint plate 12 are respectively linked with the outer axle holes 212, 222 of the first driven plate 21 and the second driven plate 22 and connected by a first axle pin 31 and a second axle pin 32. The axle holes 131, 132 at the two ends of the middle link plate assembly 13 are respectively linked with the inner axle holes 213, 223 of the first driven plate 21 and the second driven plate 22 and connected by a third axle pin 33 and a fourth axle pin 34. A fifth axle pin 35 and a sixth axle pin 36 are respectively inserted in the outer axle holes 111, 121 of the first joint plate 11 and the second joint plate 12. In an embodiment as shown in the drawings, a washer 50 is provided between two adjacent driving joint assemblies 10. The axle pins 31-36 each have an enlarged end, so that the other end can be positioned by a buckle ring (not shown in the drawings) or the like at a neck portion thereof after the axle pins are inserted through the corresponding axle holes. This is only an example, not to be limited.

A plurality of driving joint assemblies 10 and a plurality of driven joint assemblies 20 are arranged side by side, so that a plurality of first and second joint plates 11, 12 and a plurality of middle link plate assembles 13 and a plurality of first and second driven plates 21, 22 are connected by the axle pins 31-36. The axle pins 31-36 are to connect the adjacent driving joint assembles 10 and the driven joint assemblies 20 to constitute the multi-joint rotary axle structure.

Figure 4:
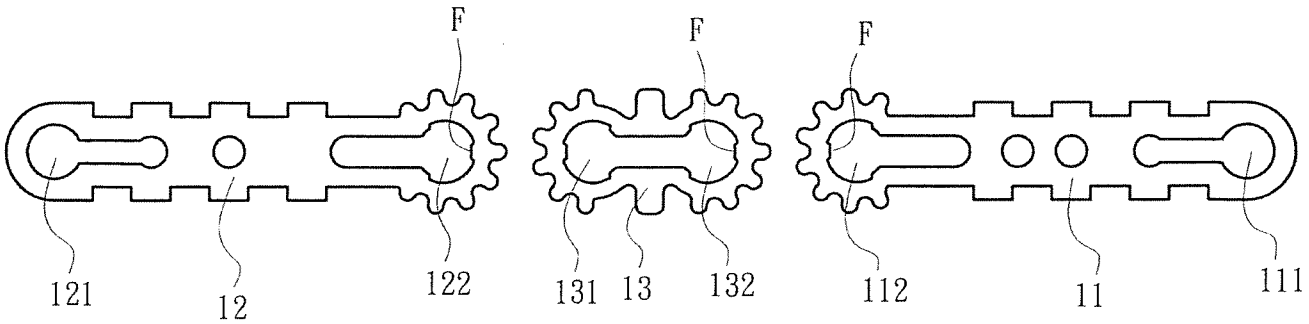
FIG. 4 is a front view of the main joint plates of FIG. 1.

As shown in FIG. 4, in a preferred embodiment, the inner axle holes 112, 122 of the two opposing first and second joint plates 11, 12 and the axle holes 131, 132 of the middle link plate assembly 13 have flanges F at respective inner peripheries thereof. The inner axle holes 213, 223 of the first and second driven plates 21, 22 also have flanges F at respective inner peripheries thereof. The flanges F provide a positioning and clamping force when the axle pins 31-34 are inserted therethrough to create a forcing and press function.

In the embodiment as shown in the drawings, it is not essential that the outer ends of the first and second driven plates 21, 22 have the synchronous actuating portions corresponding to the synchronous actuating portions of the middle link plate assembly 13. But, it would be beneficial to produce the first and second driven plates 21, 22 and the middle link plate assembly 13 which have the same configuration.

Figure 5:
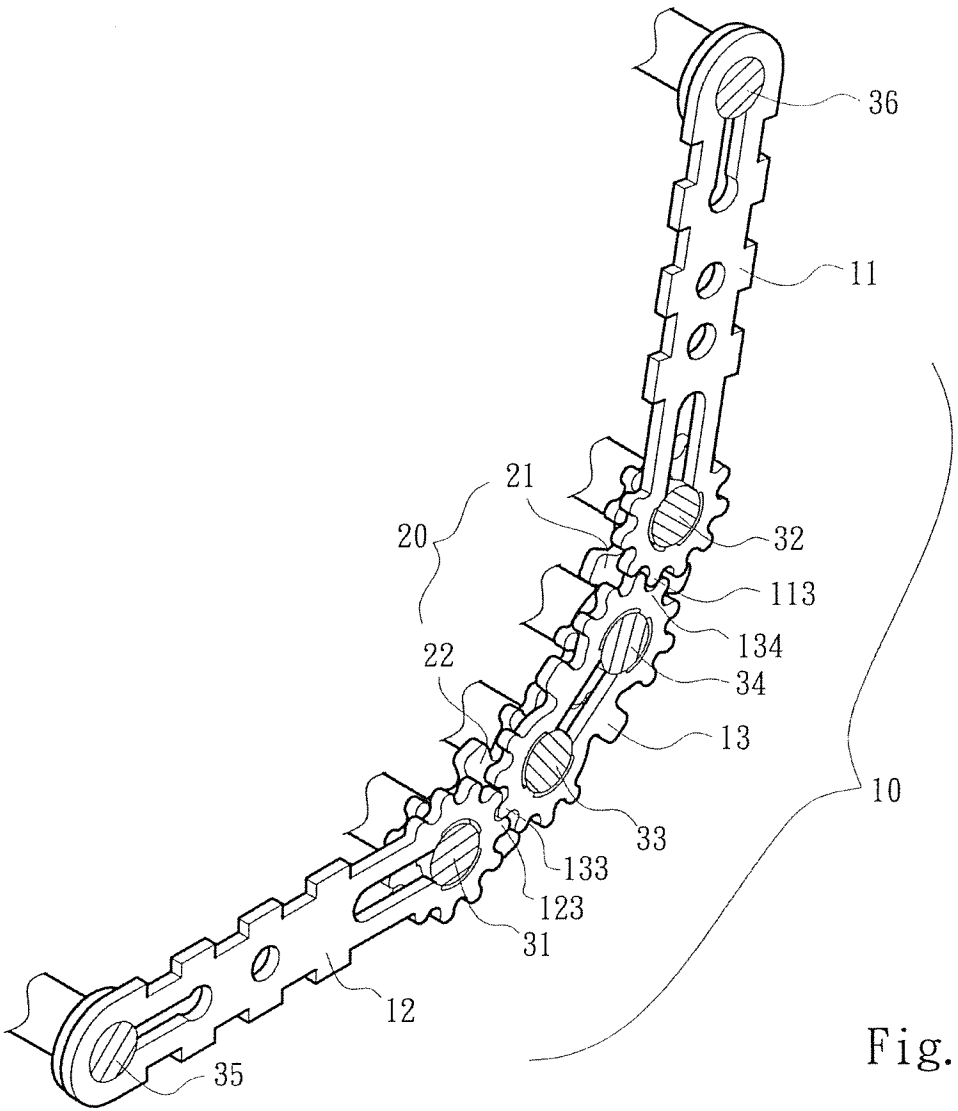
FIG. 5 is a schematic view of FIG. 3 in an initial turning state.
Figure 6:
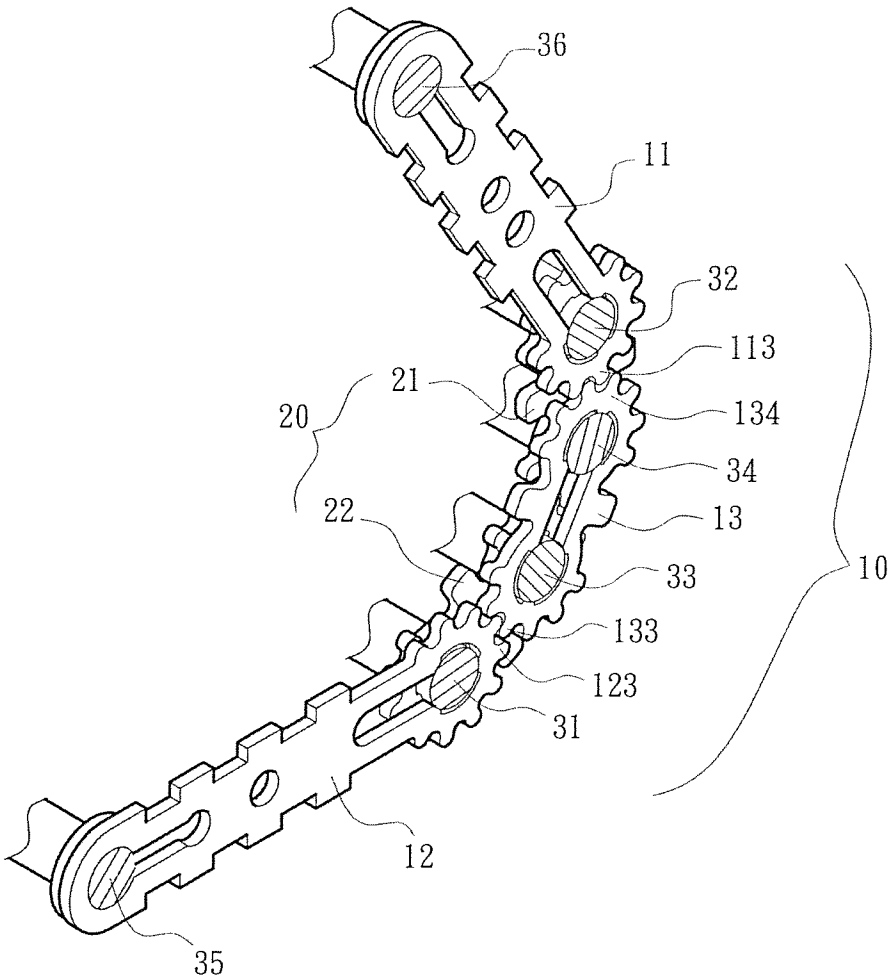
FIG. 6 is a schematic view of FIG. 5 in a further turning state.
Figure 10:
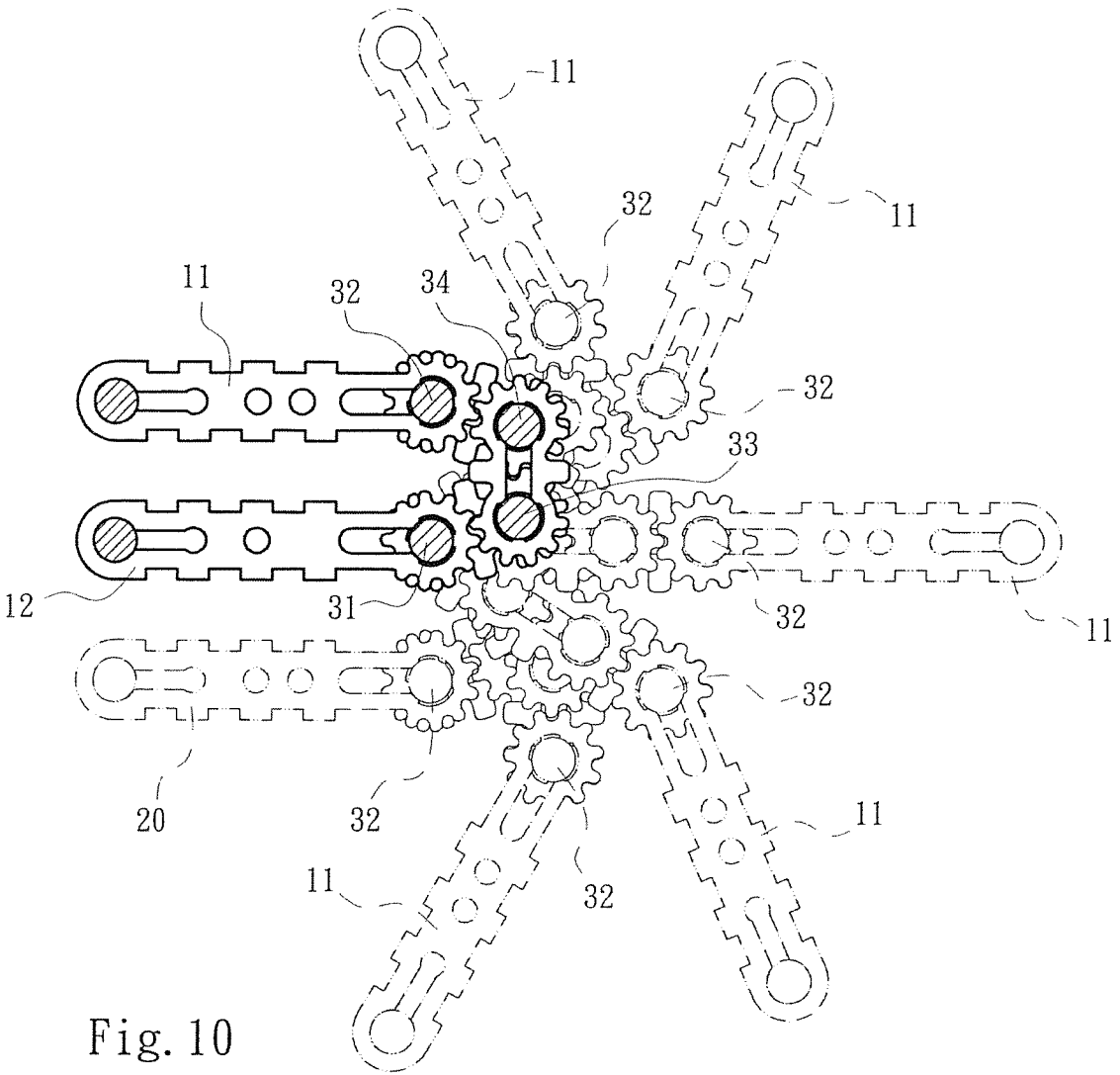
FIG. 10 is a schematic view of the embodiment of FIG. 1 at different turning angles.

As shown in FIG. 5, when one of the joint plates (namely, the first joint plate 11 or the second joint plate 12) of the driving joint assembly 10 in the aforesaid embodiment of the present invention is turned, the inner synchronously actuating portion 113 or 123 mating with the outer connecting actuating portion 133 or 134 of the middle link plate assembly 13 will drive the first middle link plate of the middle link plate assembly 13 to turn reversely and turn the first driven plate 21 of the driven joint assembly 20 synchronously. Gradually, the whole multi-joint rotary axle structure is turned synchronously. That is to say, when one of the joint plates (namely, the first joint plate 11 or the second joint plate 12) is applied with a force to turn, the other joint plate will be turned synchronously. As show in FIG. 5 and FIG. 6, if the outer end of the first joint plate 11 is turned clockwise (namely, the state in FIG. 6 is turned to the state in FIG. 5), the inner end of the first joint plate 11 will be moved clockwise relative to the outer periphery of the outer end of the middle link plate assembly 13, referring to FIG. 2, FIG. 3 and FIG. 5, to link the outer rend of the first driven plate 21 to move in the same direction so that the inner end of the first driven plate 21 is also turned clockwise. Because the synchronous actuating portions 211, 221 of the first and second driven plates 21, 22 mate with each other, the inner end of the second driven plate 22 is turned synchronously and counterclockwise, and the outer end of the second driven plate 22 is turned counterclockwise. The two opposing first and second joint plates 11, 12 are turned synchronously in opposite directions with the central line C as the reference line to fold or unfold each other, alternatively, one joint plate is moved close to or away from the other joint plate. As shown in FIG. 10, the two opposing first and second joint plates 11, 12 can be turned 0-360 degrees for a wide range of use. Furthermore, the synchronous folding device is folded or unfolded by plural turning centers to turn synchronously, which is effective to disperse the acting force and the rotary range to each turning center for smooth and light operation. The synchronous connecting relationship of both ends facilitates the two folding members to be folded or unfolded accurately so as to improve the shortcomings of the prior art.

Figure 7:
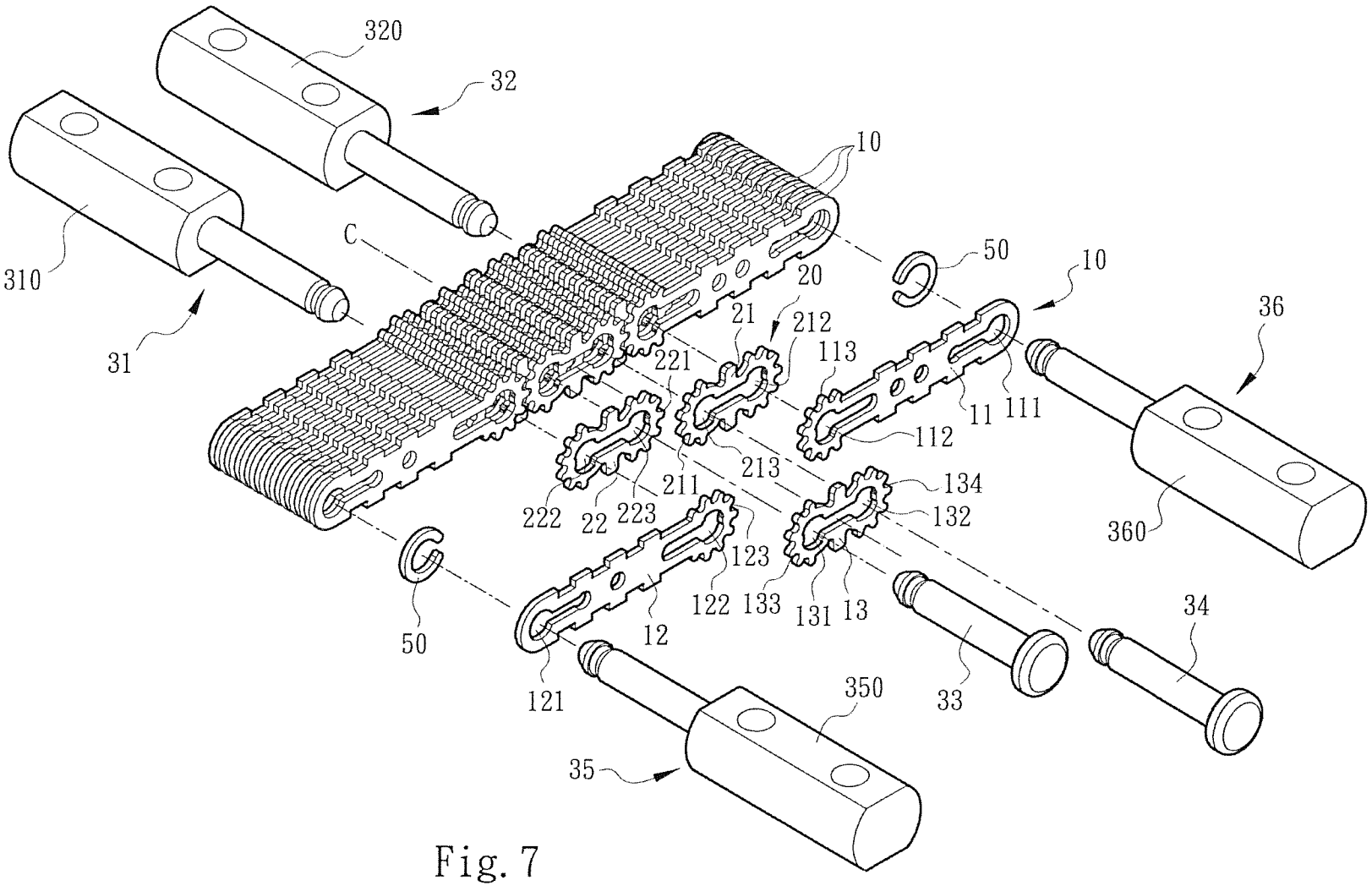
FIG. 7 is an exploded view according to another embodiment of the present invention.
Figure 8:
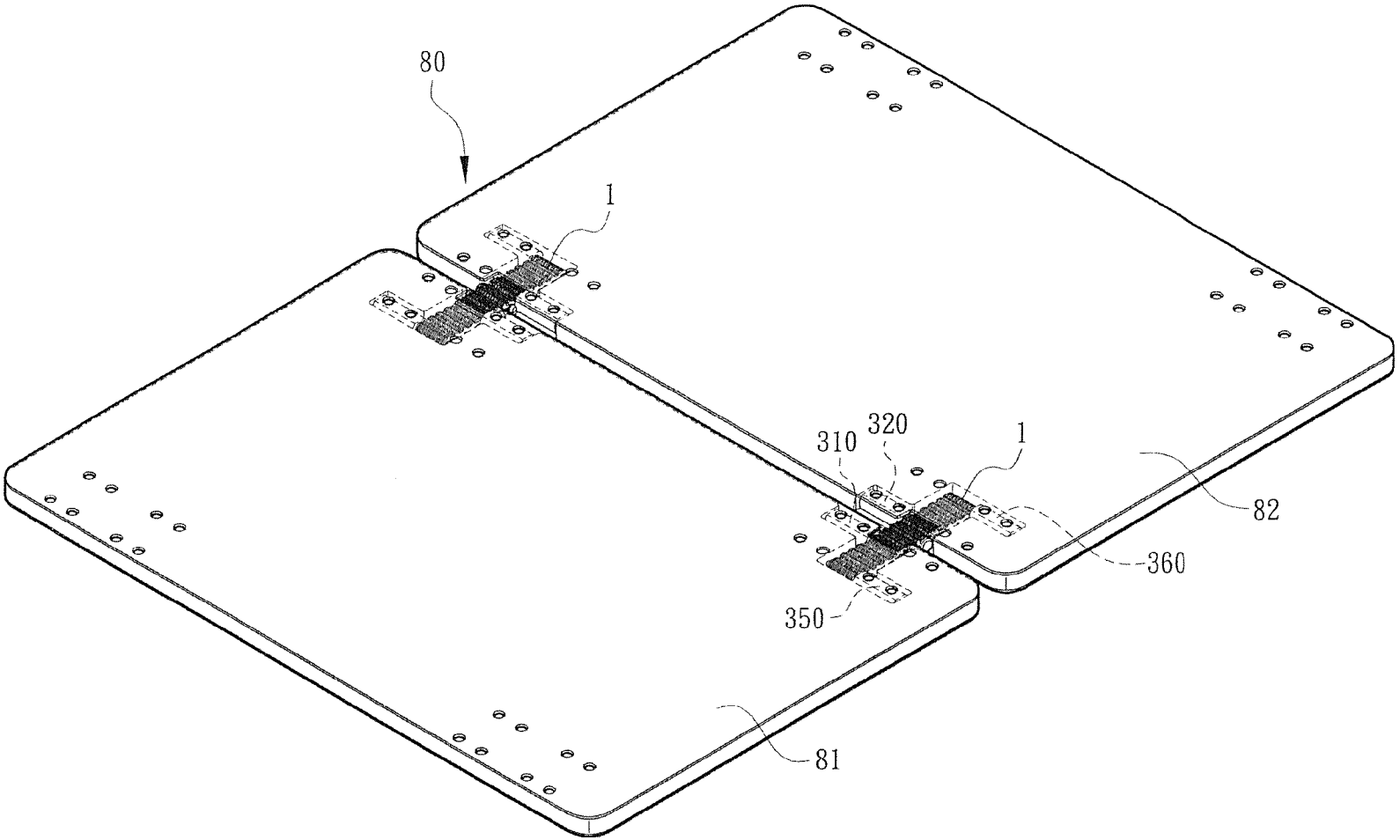
FIG. 8 is a schematic view of the embodiment of FIG. 7 applied to an electronic apparatus.
Figure 9:
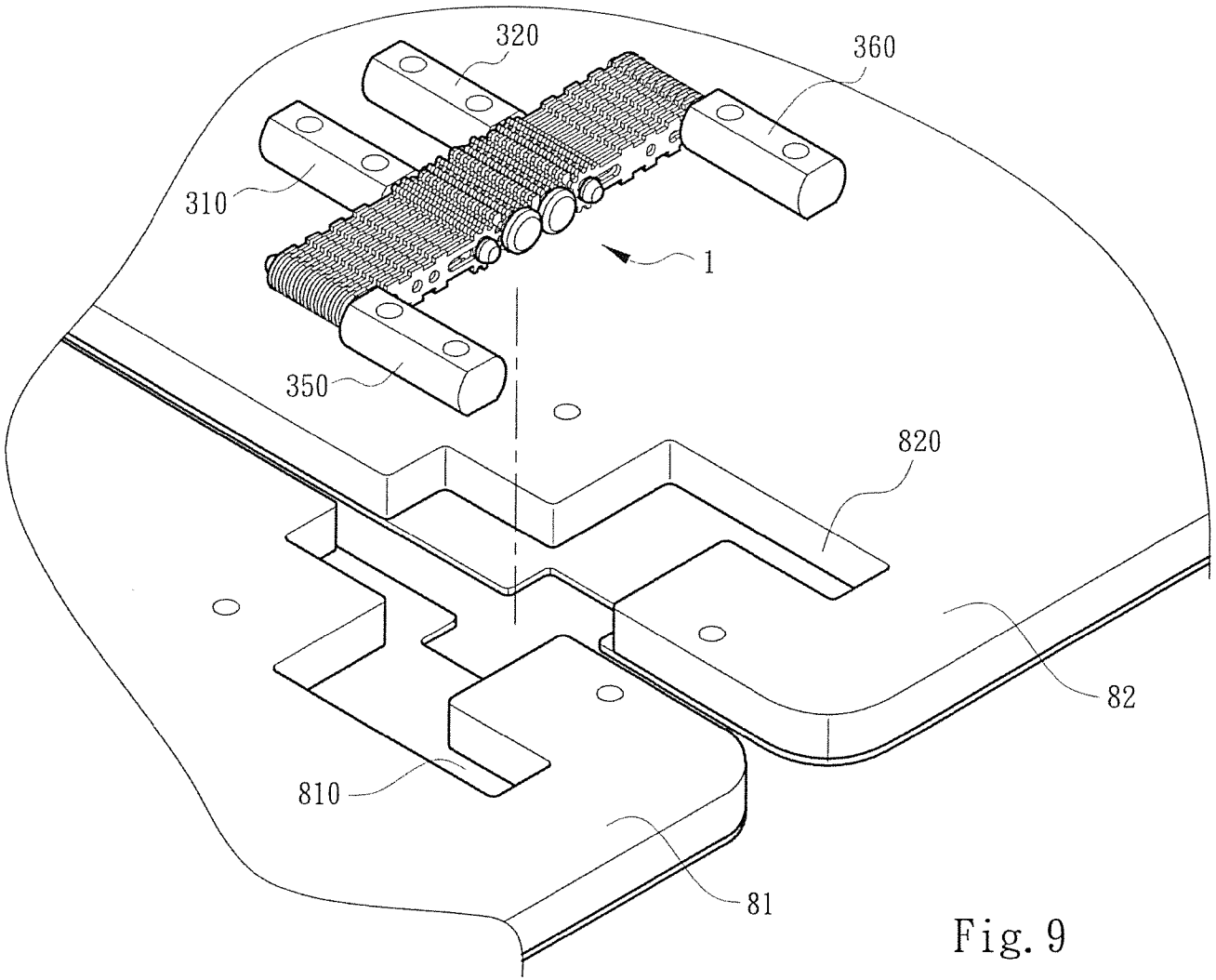
FIG. 9 is a partial enlarged view of FIG. 8.

As shown in FIG. 7 to FIG. 9, the present invention is mounted on an electronic product 80, such as a notebook. The notebook comprises a first folding member 81 as a system end and a second folding member 82 as a screen display end. In an embodiment, the first and second axle pins 31, 32 and the fifth and sixth axle pins 35, 36 have extension portions 310, 320, 350, 360, respectively. The first and second folding members 81, 82 of the notebook have corresponding recesses 810, 820 to accommodate the extension portions 310, 320, 350, 360 respectively and locked through predetermined opposing holes.

Figure 11:
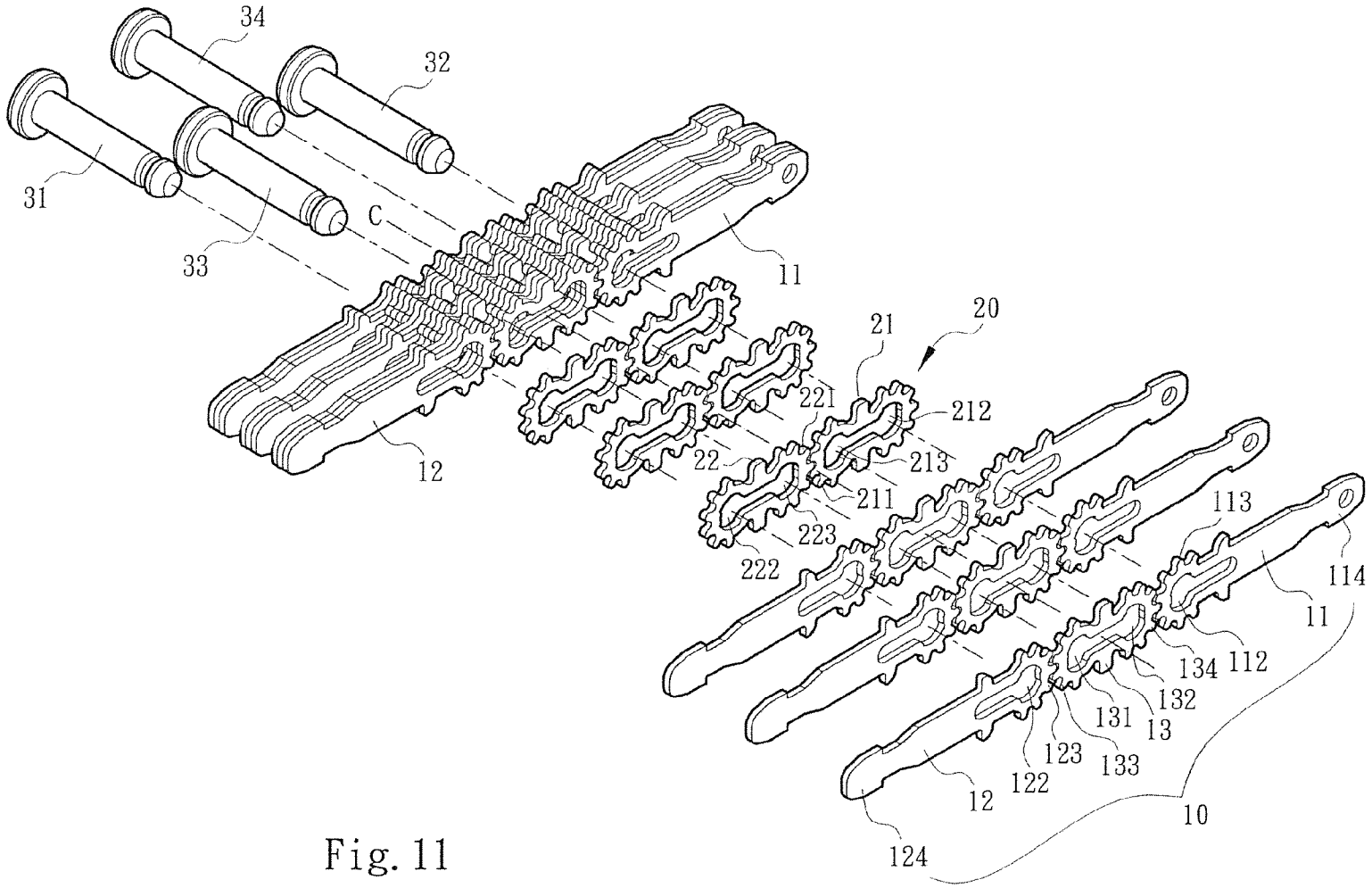
FIG. 11 is an exploded view according to another embodiment of the present invention.
Figure 12:
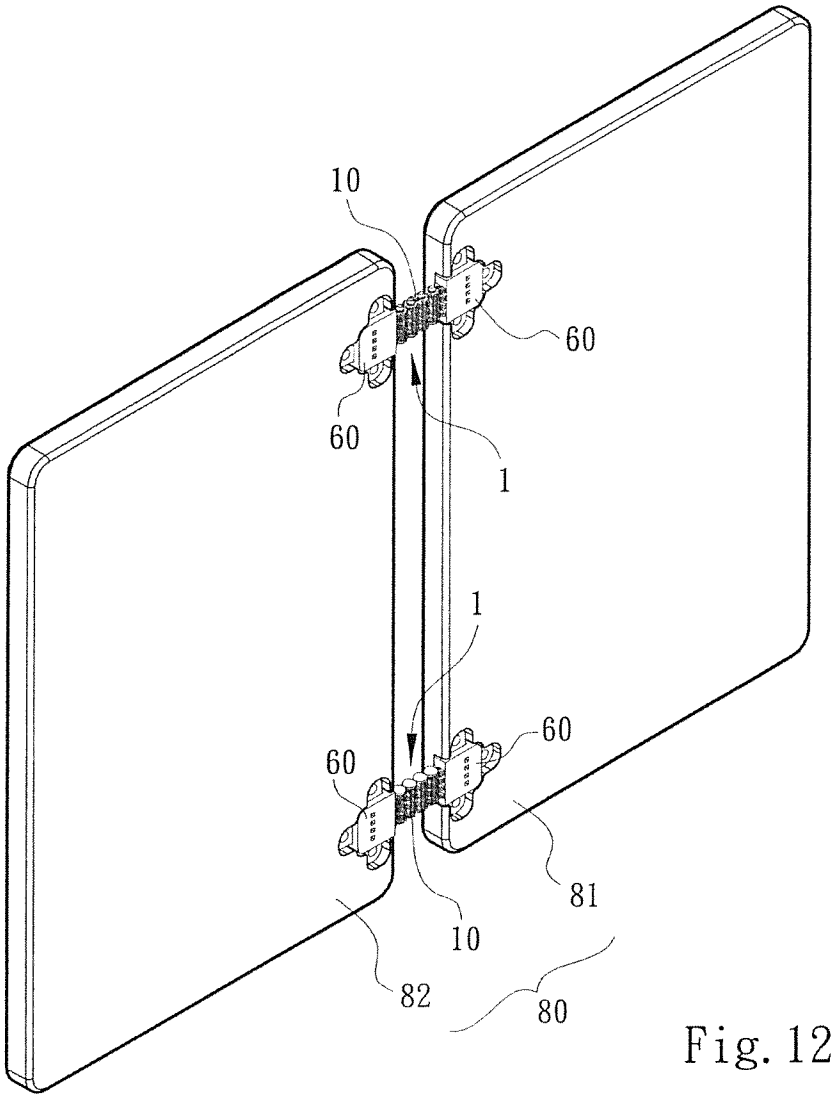
FIG. 12 is a schematic view of the embodiment of FIG. 11 applied to an electronic apparatus.
Figure 13:
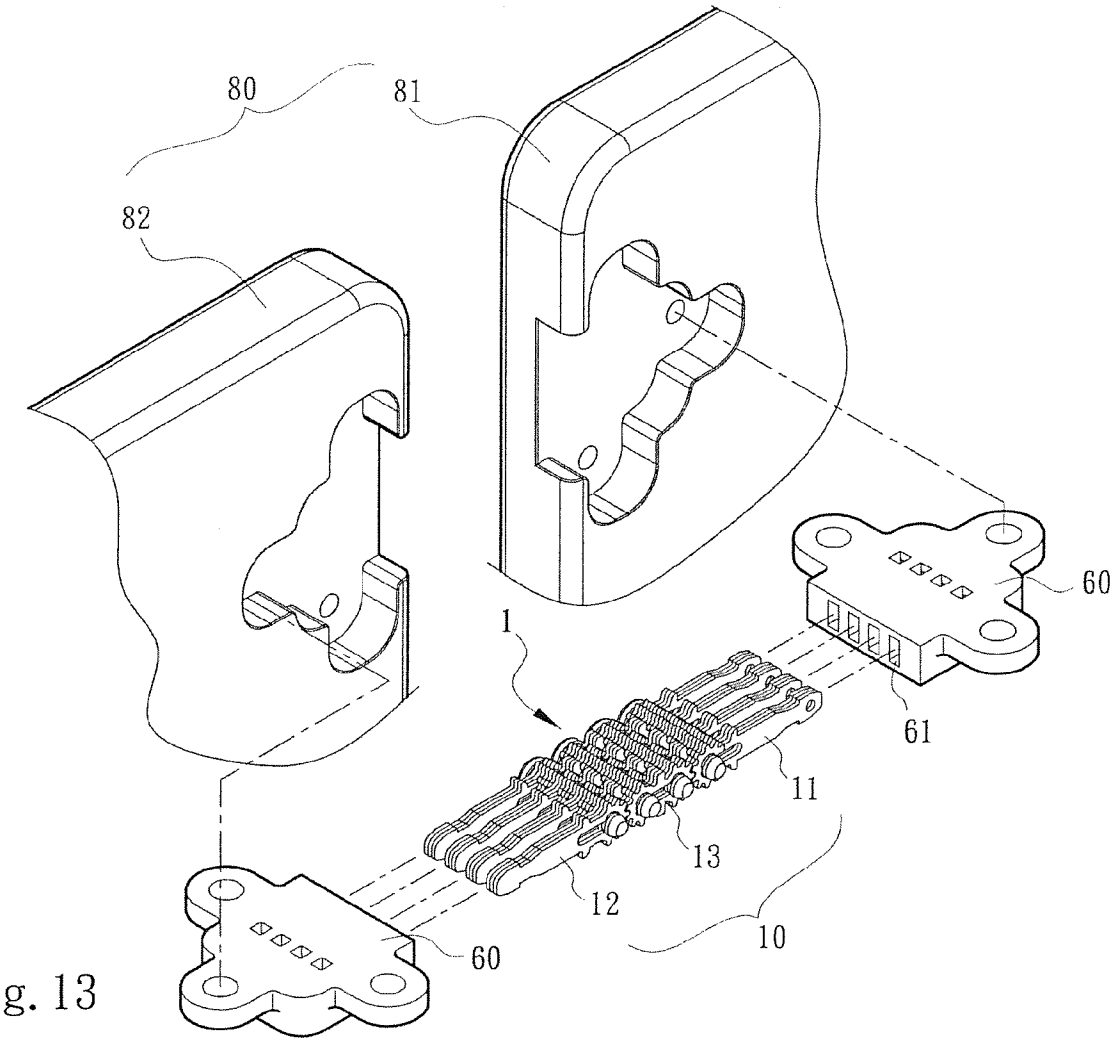
FIG. 13 is a partial enlarged view of FIG. 12.
Figure 14:
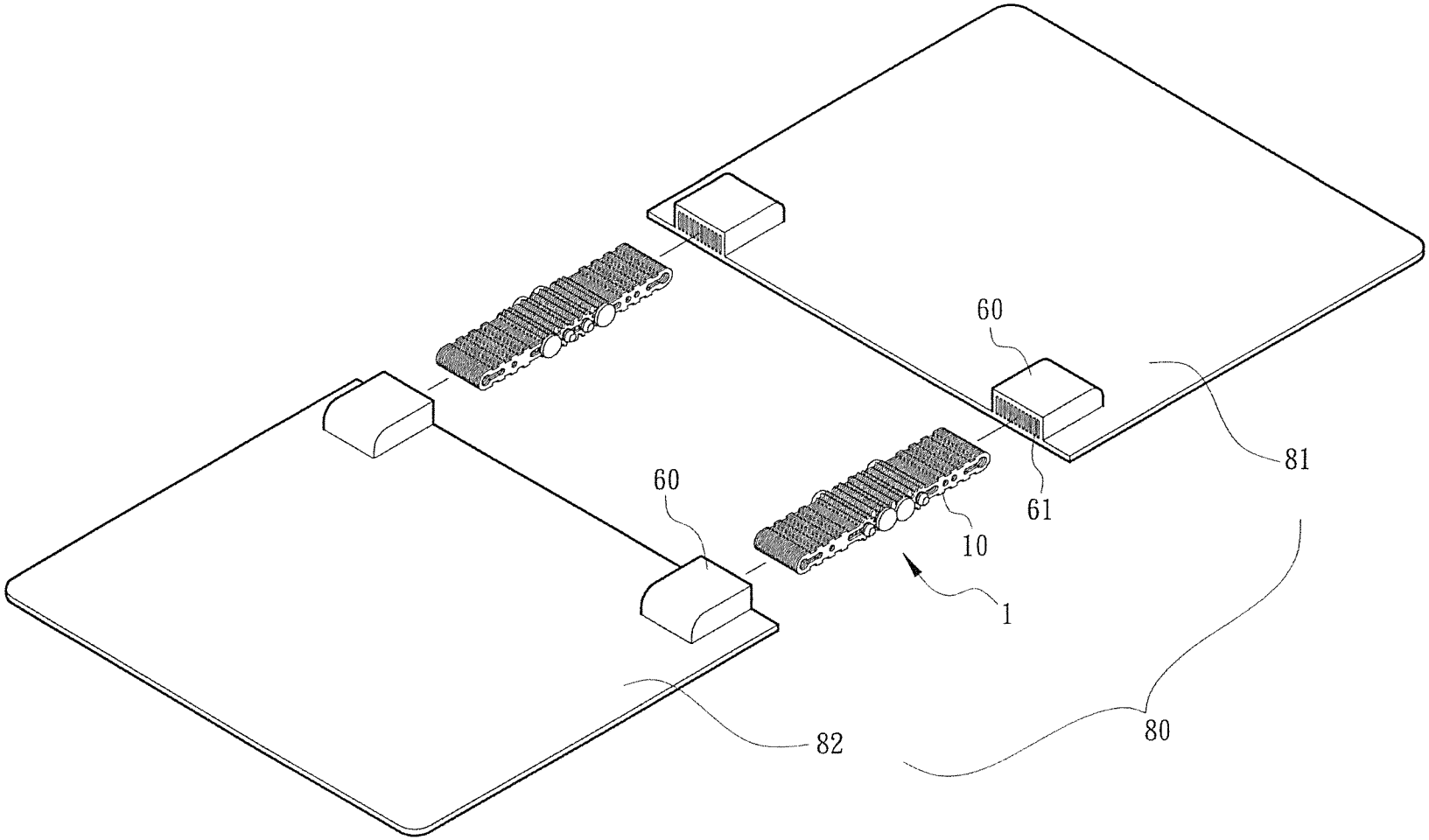
FIG. 14 is a schematic view of the present invention applied to another electronic apparatus.

As shown in FIG. 11 to FIG. 14, in an embodiment, at least one of the outer ends of the first and second joint plates 11, 12 are formed with an insertion head 114, 124. A connection member 60 is provided between the two joint plates 11, 12 and the two folding members 81, 82. The connection member 60 can be separate from the two folding members 81, 82 and locked by a lock member, as shown in FIG. 11 to FIG. 13, alternatively, the connection member 60 is integrally formed with the two folding members 81, 82. The connection member 60 has an insertion trough 61 to receive the insertion head 114, 124 for convenient, quick and accurate assembly of the multi-joint rotary axle structure and the two folding members.

Figure 15:
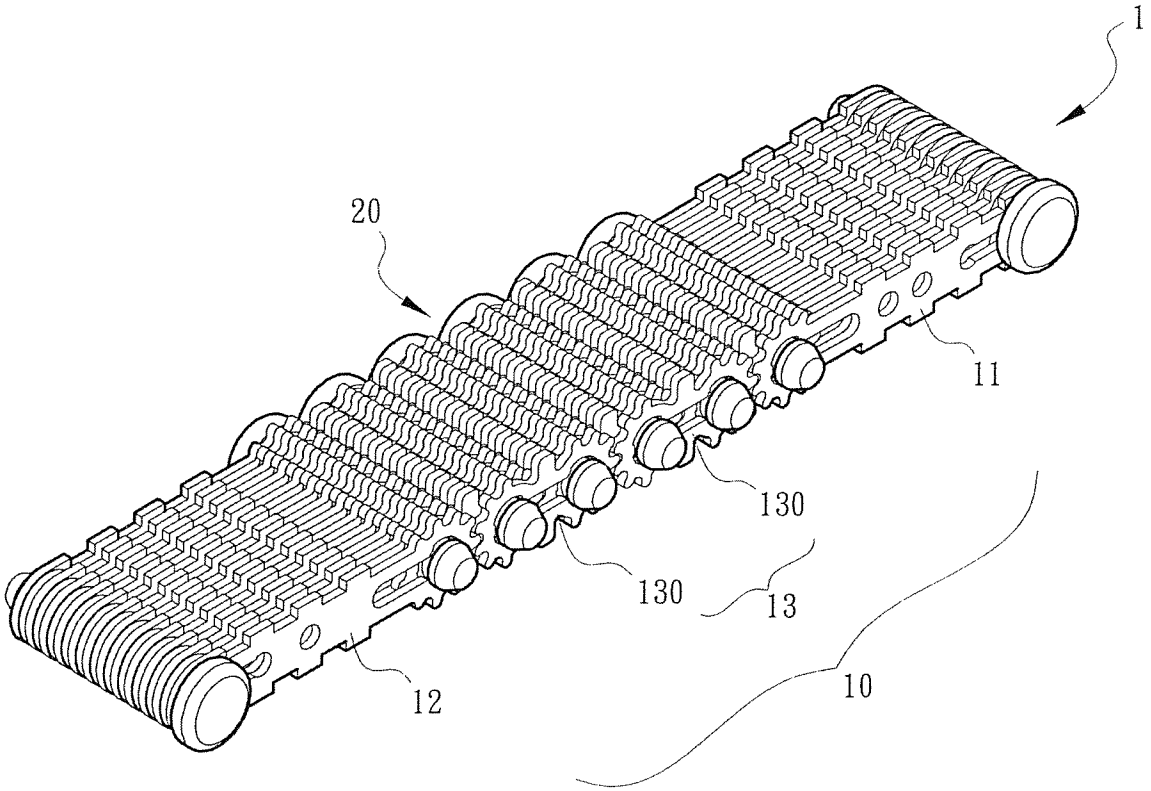
FIG. 15 is a perspective view of a further embodiment of the present invention.

As shown in FIG. 15, the middle link plate assembly 13 comprises at least two connected middle link plates 130. Between the first driven plate 21 and the second driven plate 22 of the driven joint assembly 20 is connected with at least one middle driven plate to operate the first driven plate 21 and the second driven plate 22 synchronously. The middle link plates 130 are pivotally connected to each middle driven plate for turning operation of the multi-joint rotary axle structure.

The present invention has plural turning centers to enhance the accuracy of turning and to be folded or unfolded with ease. When the present invention is mounted to two separate folding members of an electronic apparatus (such as detachable monitor, handheld game console, PDA, cell phone, electronic book, outer casing of an electronic product, or the like), both ends can be folded or unfolded synchronously so that the rotary axle can be turned smoothly.

The synchronous actuating portions and the connecting actuating portions are corresponding toothed portions, opposing rubbing parts, interconnected synchronous pulling parts or other equivalent parts. Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A synchronous folding device, comprising two opposing folding members and a multi-joint rotary axle structure mounted between the two folding members, the multi-joint rotary axle structure having two ends which are able to be folded or unfolded synchronously;

wherein the multi-joint rotary axle structure comprises at least one driving joint assembly and at least one driven joint assembly which are connected through a pivot means;

the driving joint assembly comprising two opposing joint plates and a middle link plate assembly, the two opposing joint plates comprising a first joint plate and a second joint plate, the two opposing joint plates having synchronous actuating portion at respective inner ends thereof, the middle link plate assembly having connecting actuating portions at two ends thereof to mate with the synchronous actuating portions;

the driven joint assembly being pivotally connected between the inner ends of the two opposing joint plates, the driven joint assembly comprising at least two first and second driven plates which are driven synchronously and inward, the inner ends of the two opposing joint plates being pivotally connected with outer ends of the first and second driven plates, the two ends of the middle link plate assembly being pivotally connected with inner ends of the first and second driven plates.

2. The synchronous folding device as claimed in claim 1, wherein the two opposing joint plates have outer axle holes and inner axle holes close to respective two ends thereof, the middle link plate assembly having axle holes close to the two ends thereof, the two driven plates having outer axle holes and inner axle holes, the inner axle holes of the two opposing joint plates being respectively linked with the outer axle holes of the two driven plates and connected by axle pins, the axle holes of the middle link plate assembly being respectively linked with the inner axle holes of the two driven plates and connected by another additional axle pins.

3. The synchronous folding device as claimed in claim 1, wherein the two opposing joint plates have outer axle holes and inner axle holes close to respective two ends thereof, the middle link plate assembly having axle holes close to the two ends thereof, the two driven plates having outer axle holes and inner axle holes, the inner axle holes of the two opposing joint plates being respectively linked with the outer axle holes of the two driven plates and connected by axle pins, the axle holes of the middle link plate assembly being respectively linked with the inner axle holes of the two driven plates, at least one of the outer ends of the first and second joint plates being formed with an insertion head, a connection member being provided between one of the two folding members and the insertion head, the connection member having an insertion trough to receive the insertion head.

4. The synchronous folding device as claimed in claim 3, wherein the connection member is separate from the corresponding folding member and connected by a lock member.

5. The synchronous folding device as claimed in claim 3, wherein, the connection member is integrally formed with the corresponding folding member.

6. The synchronous folding device as claimed in claim 2, wherein the inner axle holes of the two opposing joint plates, the axle holes of the middle link plate assembly and the inner axle holes of the two driven plates have flanges at respective inner peripheries thereof for the axle pins to be connected tightly.

7. The synchronous folding device as claimed in claim 3, wherein the inner axle holes of the two opposing joint plates, the axle holes of the middle link plate assembly and the inner axle holes of the two driven plates have flanges at respective inner peripheries thereof for the axle pins to be connected tightly.

8. The synchronous folding device as claimed in claim 1, wherein the middle link plate assembly comprises at least two connected middle link plates, the middle link plates each having synchronous actuating portions at opposing ends thereof to connect with each other, between the first driven plate and the second driven plate of the driven joint assembly being connected with at least one middle driven plate, opposing ends of the middle link plate being pivotally connected to two ends of the middle driven plate.

9. The synchronous folding device as claimed in claim 2, wherein the middle link plate assembly comprises at least two connected middle link plates, the middle link plates each having synchronous actuating portions at opposing ends thereof to connect with each other, between the first driven plate and the second driven plate of the driven joint assembly being connected with at least one middle driven plate, opposing ends of the middle link plate being pivotally connected to two ends of the middle driven plate.

10. The synchronous folding device as claimed in claim 3, wherein the middle link plate assembly comprises at least two connected middle link plates, the middle link plates each having synchronous actuating portions at opposing ends thereof to connect with each other, between the first driven plate and the second driven plate of the driven joint assembly being connected with at least one middle driven plate, opposing ends of the middle link plate being pivotally connected to two ends of the middle driven plate.

11. The synchronous folding device as claimed in claim 6, wherein the middle link plate assembly comprises at least two connected middle link plates, the middle link plates each having synchronous actuating portions at opposing ends thereof to connect with each other, between the first driven plate and the second driven plate of the driven joint assembly being connected with at least one middle driven plate, opposing ends of the middle link plate being pivotally connected to two ends of the middle driven plate.

12. The synchronous folding device as claimed in claim 7, wherein the middle link plate assembly comprises at least two connected middle link plates, the middle link plates each having synchronous actuating portions at opposing ends thereof to connect with each other, between the first driven plate and the second driven plate of the driven joint assembly being connected with at least one middle driven plate, opposing ends of the middle link plate being pivotally connected to two ends of the middle driven plate.

13. The synchronous folding device as claimed in claim 1, wherein the pivot means are axle pins, the axle pins having respective extension portions, the folding members having corresponding recesses to accommodate the extension portions.

14. The synchronous folding device as claimed in claim 2, wherein the pivot means are axle pins, the axle pins having respective extension portions, the folding members having corresponding recesses to accommodate the extension portions.

15. The synchronous folding device as claimed in claim 3, wherein the pivot means are axle pins, the axle pins having respective extension portions, the folding members having corresponding recesses to accommodate the extension portions.

16. The synchronous folding device as claimed in claim 8, wherein the pivot means are axle pins, the axle pins having respective extension portions, the folding members having corresponding recesses to accommodate the extension portions.

17. The synchronous folding device as claimed in claim 1, wherein the synchronous actuating portions and the connecting actuating portions are corresponding toothed portions.

18. The synchronous folding device as claimed in claim 2, wherein the synchronous actuating portions and the connecting actuating portions are corresponding toothed portions.

19. The synchronous folding device as claimed in claim 3, wherein the synchronous actuating portions and the connecting actuating portions are corresponding toothed portions.

20. The synchronous folding device as claimed in claim 8, wherein the synchronous actuating portions and the connecting actuating portions are corresponding toothed portions.

21. The synchronous folding device as claimed in claim 13, wherein the synchronous actuating portions and the connecting actuating portions are corresponding toothed portions.

22. The synchronous folding device as claimed in claim 1, wherein the synchronous actuating portions and the connecting actuating portions are opposing rubbing parts.

23. The synchronous folding device as claimed in claim 2, wherein the synchronous actuating portions and the connecting actuating portions are opposing rubbing parts.

24. The synchronous folding device as claimed in claim 3, wherein the synchronous actuating portions and the connecting actuating portions are opposing rubbing parts.

25. The synchronous folding device as claimed in claim 8, wherein the synchronous actuating portions and the connecting actuating portions are opposing rubbing parts.

26. The synchronous folding device as claimed in claim 13, wherein the synchronous actuating portions and the connecting actuating portions are opposing rubbing parts.

27. The synchronous folding device as claimed in claim 1, wherein the synchronous actuating portions and the connecting actuating portions are interconnected synchronous pulling parts.

28. The synchronous folding device as claimed in claim 2, wherein the synchronous actuating portions and the connecting actuating portions are interconnected synchronous pulling parts.

29. The synchronous folding device as claimed in claim 3, wherein the synchronous actuating portions and the connecting actuating portions are interconnected synchronous pulling parts.

30. The synchronous folding device as claimed in claim 8, wherein the synchronous actuating portions and the connecting actuating portions are interconnected synchronous pulling parts.

31. The synchronous folding device as claimed in claim 13, wherein the synchronous actuating portions and the connecting actuating portions are interconnected synchronous pulling parts.

32. The synchronous folding device as claimed in claim 1, wherein the multi-joint rotary axle structure comprises a plurality of driving joint assemblies and driven joint assemblies which are connected by a plurality axle pins.

33. The synchronous folding device as claimed in claim 2, wherein the multi-joint rotary axle structure comprises a plurality of driving joint assemblies and driven joint assemblies which are connected by a plurality axle pins.

34. The synchronous folding device as claimed in claim 3, wherein the multi-joint rotary axle structure comprises a plurality of driving joint assemblies and driven joint assemblies which are connected by a plurality axle pins.

35. The synchronous folding device as claimed in claim 8, wherein the multi-joint rotary axle structure comprises a plurality of driving joint assemblies and driven joint assemblies which are connected by a plurality axle pins.

36. The synchronous folding device as claimed in claim 13, wherein the multi-joint rotary axle structure comprises a plurality of driving joint assemblies and driven joint assemblies which are connected by a plurality axle pins.

37. The synchronous folding device as claimed in claim 17, wherein the multi-joint rotary axle structure comprises a plurality of driving joint assemblies and driven joint assemblies which are connected by a plurality axle pins.

38. The synchronous folding device as claimed in claim 27, wherein the multi-joint rotary axle structure comprises a plurality of driving joint assemblies and driven joint assemblies which are connected by a plurality axle pins.

* * * * *